US006846271B2

(12) United States Patent
Publicover

(10) Patent No.: US 6,846,271 B2
(45) Date of Patent: Jan. 25, 2005

(54) TRAMPOLINE SYSTEM WITH PLURAL BEDS

(76) Inventor: Mark W. Publicover, 18505 Marshall La., Saratoga, CA (US) 95070

( * ) Notice: Subject to any disclaimer, the term of this patent is extended or adjusted under 35 U.S.C. 154(b) by 122 days.

(21) Appl. No.: 10/240,387

(22) PCT Filed: Aug. 14, 2001

(86) PCT No.: PCT/US01/41736

§ 371 (c)(1),
(2), (4) Date: Sep. 27, 2002

(87) PCT Pub. No.: WO02/13913

PCT Pub. Date: Feb. 21, 2002

(65) Prior Publication Data

US 2003/0104905 A1 Jun. 5, 2003

Related U.S. Application Data

(60) Provisional application No. 60/225,326, filed on Aug. 14, 2000.

(51) Int. Cl.[7] ..... A63B 5/11

(52) U.S. Cl. ..... 482/27; 472/135; 182/139

(58) Field of Search ..... 482/23, 26–29; 182/139; 472/135; 5/710

(56) References Cited

U.S. PATENT DOCUMENTS

| | | | | |
|---|---|---|---|---|
| 4,598,904 A | | 7/1986 | Roth | |
| 4,863,156 A | | 9/1989 | Shaw | |
| 4,938,473 A | * | 7/1990 | Lee et al. | 482/54 |
| 5,299,989 A | * | 4/1994 | Boyd et al. | 482/27 |
| 5,729,852 A | * | 3/1998 | Rabideau et al. | 5/710 |
| 6,017,292 A | | 1/2000 | Gift et al. | |

* cited by examiner

*Primary Examiner*—Glenn E. Richmon
(74) *Attorney, Agent, or Firm*—Klarquist Sparkman, LLP

(57) ABSTRACT

A trampoline system has a rebounding bed and a resilient member located below the bed at such a position that the bed depresses the resilient member when the bed is sufficiently depressed by a person jumping on the bed. The presence of the resilient member makes it easy to tune the system to adjust the performance of the trampoline and to minimize impacts on a jumper and thereby reduce the likelihood of bed-impact injuries.

16 Claims, 3 Drawing Sheets

TRAMPOLINE SYSTEM WITH PLURAL BEDS

CROSS-REFERENCE TO RELATED APPLICATION

This is the National Stage of International Application No. PCT/US01/41736, filed Aug. 14, 2001, which claims the benefit of U.S. Provisional Application No. 60/225,326, filed Aug. 14, 2000.

The present invention concerns systems for use with trampolines to protect trampoline users from injury.

Trampolines are used for a variety of athletic and recreational purposes. However, thousands of injuries have resulted when persons jumping on a trampoline have landed on the rebounding surface while in an awkward or incorrect body position. These "on-bed" injuries, according to some medical studies, represent the majority of trampoline-related emergency room visits. The U.S. Consumer Products Safety Commission (CPSC) reports that in 1999 approximately 110,000 people were treated in emergency rooms for trampoline related injuries. Even though this number is half that of play structure (or swing set) injuries, some in the medical community have called for a ban on the sale of backyard trampolines. Accordingly the CPSC and the AAOS have called for safety improvements to help reduce the number of trampoline injuries.

One approach to reducing trampoline injuries has been to form a wall around the perimeter of a trampoline bed so that when a jumper lands too near the edge, the wall prevents the jumper from falling off. Examples are shown in U.S. Pat. Nos. 5,399,132 and 6,053,845. However, these devices do not directly address injuries that result when users impact the rebounding surface incorrectly or while in an awkward position. A second approach, the use of a harness (worn by the jumper) suspended by elastic cords above the rebounding surface, is an effective way to reduce on-bed, or rebound surface impact injuries. However, such harnesses are designed for safely teaching users advanced acrobatics on high-performance competition trampolines by trained professionals, making them largely inappropriate for low-performance backyard trampolines that are used almost entirely for basic jumping activities and not for advanced acrobatics.

Injuries suffered during an impact with the rebounding surface are still occurring in large numbers on backyard trampoline beds even though these beds are designed to be less responsive and to have less initial surface tension than gymnastic grade, competition trampoline beds.

Low performance backyard trampolines are used very differently than high performance trampolines used by skilled competitors for training and competition. For instance, many on-bed backyard trampoline injuries occur when multiple jumpers are using the trampoline at the same time as reported in the NEISS data compiled by the CPSC. Because children enjoy playing together most families allow more than one child to jump at the same time even though this practice is strongly discouraged by trampoline manufacturers, the CPSC, and others experts. Competition trampolines are used almost exclusively in disciplined environments for the structured teaching of specific skills. In contrast, backyard trampolines are largely used for fun, unstructured, imaginative play activities that are relished by kids and recommended by child development experts who understand that daily physical activity significantly enhances learning ability and that kids need activities to counterbalance today's over-structured and sedentary lifestyles. Unfortunately, these unstructured trampoline activities can generate on-bed injuries when jumpers land on the rebounding surface in an awkward body position or when a jumper lands on a trampoline bed that has been preloaded with the energy from other jumper impacts.

There thus remains a need to significantly reduce the quantity and severity of the on-bed injuries that result from these playful activities.

DETAILED DESCRIPTION

Figure 1:
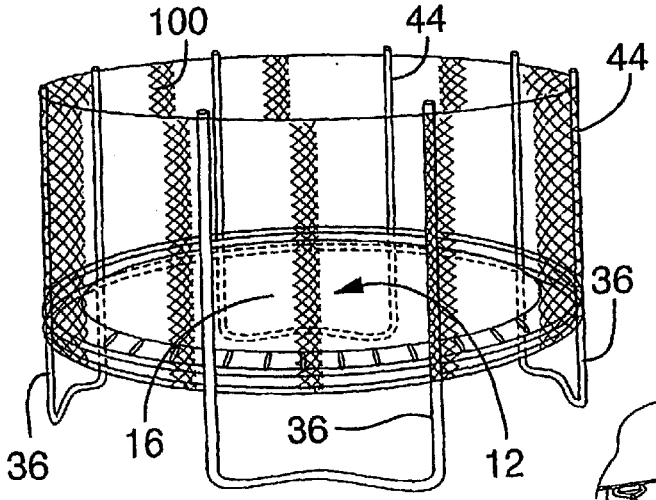
FIG. 1 is an oblique view of a first plural-bed trampoline system.
Figure 2:
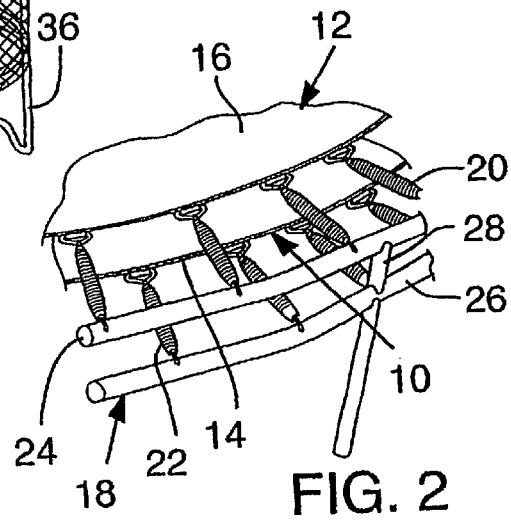
FIG. 2 is an enlarged partial oblique view of the system of FIG. 1.
Figure 3:
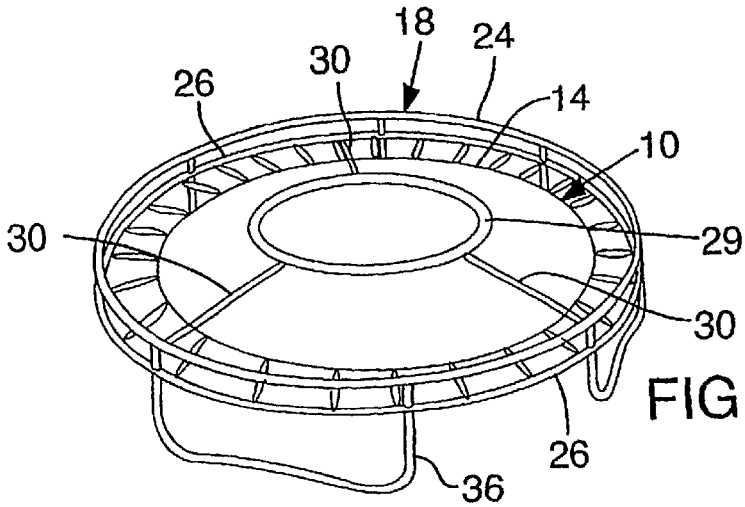
FIG. 3 is an oblique view of the of the system of FIG. 1 with the top bed removed to show internal structure
Figure 4:
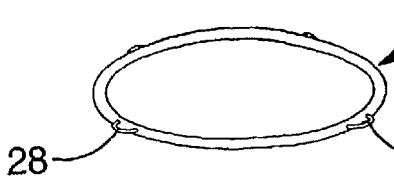
FIG. 4 is an oblique view of an inflated cushion used between the beds of the system of FIG. 1.

The drawbacks of prior systems are overcome by the use of a trampoline system that employs one or more resilient members 10 located below the rebounding bed 12 of a trampoline. A resilient member 10 is located at a position selected so that the bed 12 depresses the resilient member 10 when the bed is sufficiently depressed by a person jumping on the bed.

Such a trampoline system is effective at reducing on-bed injuries that result from multiple jumpers and awkward landings. For instance, many injuries occur when multiple users are jumping asynchronously, a first jumper deflects the bed and loads springs with the energy from his fall and now a second jumper lands on the bed in an awkward position. At this point in time, the bed is highly tensioned (unforgiving) and has just begun moving rapidly upward, recycling the energy loaded into the springs by the first jumpers impact with the bed. In this case a bed/resilient member system can be used to significantly reduce the impact force being experienced by the second jumper, thereby helping to prevent an injury.

The primary function of the system is to provide a "softer," more cushioned, and shock-absorbing surface on the rebounding bed, with supplemental delayed support from the resilient member 10 if and when needed to absorb greater impact loads not fully managed by the bed.

The resilient member 10 may comprise a bed of planar material 14 that is positioned at a distance below and extends generally parallel to the rebounding bed 16 and that is supported by a frame 18. For example, FIGS. 1–6 show embodiments that are double-bed trampolines. A double-bed trampoline uses two rebounding beds, an upper bed 16 and a lower bed 14 directly below. The upper bed 16 is configured in the manner of current trampoline systems system with a rebounding mat stretched on a frame. The lower bed 14 is located directly below and also has a mat that comprises a sheet of stretched fabric. The spacing between the mats can vary, but good results are achieved with a spacing of at least six inches for trampolines of the type common for home use. (More than two beds could be employed, but the greatest portion of the benefit is obtained by adding one bed to serve as a resilient member in addition to the regular rebounding bed 16.)

Because there are two beds, the upper bed 16 can have fewer "standard" springs 20 than a single bed trampoline that is required to safely meet the same performance standards. For example, the upper bed 16 could have half as many springs (or an equal number of weaker springs that generate half the net spring resistance, or a combination of weaker springs and fewer regular springs) as a conventional single trampoline bed. This configuration would practically cut in half the impact force that the second jumper's body would need to absorb and thereby significantly reduce the likelihood of an injury.

All things being equal, a bed with less tension is more forgiving when a jumper first contacts its surface, it absorbs the impact more slowly and will thus reduce the severity and quantity of on-bed injuries. Thus, the upper bed 16 will absorb a jumper's impact more slowly if that bed is supported with fewer and/or weaker springs than would normally be used for a single bed trampoline. It is possible to use fewer and/or weaker springs in the upper bed 16 because the lower bed 14 is present to absorb part of the impact energy.

The extended absorption time helps to prevent injuries in three ways: 1) It allows the jumper more time to reposition his body into a less awkward or injury-prone position. 2) It allows more time for the energy from an impact to transfer throughout the body thereby lessening the stress in any localized area. 3) It allows the mat to conform more completely to the user's body; it allows more of the mat to come in contact with the user's body, spreading the load over a larger area and thereby lessening the load on a given area, or point of the body. (Springs 20 on the upper bed 16 are not allowed to ever reach their maximum stretch. The upper bed 16 can be more porous and move up faster, creating greater separation between the two beds to allow for more energy to be absorbed by the first bed 16 prior to an impact with the second bed 14. This is important when a bed has absorbed the energy and is in a deflected position from a first jumpers impact.)

The system shown in FIGS. 1–4 has a frame 18 that includes two circular rails, upper 24 and lower 26, with the top mat 16 connected by springs 20 to the top of the upper rail and the lower mat connected by springs 22 to the bottom of the lower rail. Between the rails 24, 26 are vertical tubes 28 that hold the rails at a desired spacing from each other. (Although continuous circular rails are illustrated, it should be appreciated that perimeter trampoline rails may form various shapes including circles and rectangles. And the rails most commonly are made of multiple segments that are joined end-to-end, for example by swage fittings.)

The illustrated resilient member 10 also comprises a cushion member, in the form of an inflated air bladder 26 that is provided between the beds to help maintain the spacing between the beds during an impact and to modify the shock-absorbing properties of the system. Depending on the result desired, appropriate cushions could be designed so as to prevent the two trampoline beds from ever coming into contact with one another, or could be designed to deform and allow mat-to-mat contact when a there is an impact of sufficient force on the top of the rebounding mat.

The illustrated bladder is generally ring-shaped and has a plurality of attachment loops 28 that extend from the bladder toward the frame 18. The bladder is tethered to the frame 18 by a plurality of elongated tethers 30, such as lengths of flexible fabric webbing that extend between the bladder and the frame. The tethers 30 are secured to the bladder and the frame 18 and hold the bladder is a position that is generally horizontally centered below the bed 16. The cushion rests on the lower mat 14 with a small air gap of about 2–3 inches provided between the top of the cushion and the upper mat 16. The cushion could be of sufficient elevation as to be in contact with both mats, but it is advantageous to allow room for the first mat to descend a small distance before it encounters the resilient member 10. The upper mat 16 is thus initially more flexible, and there is less wear on the resilient member 10 due to friction.

A number of alternative frame constructions can be used to provide support for two or more beds. For example, a frame could have two or more smaller rails spaced apart by angled cross tubing and configured in a truss-like fashion to create greater strength with less material weight. Or a frame could be constructed from single larger tube (oval, square, round, etc.) with a cross-sectional diameter sufficient to create the desired spacing between the upper and lower beds.

The resilient member need not be supported by the same frame 18 that supports the rebounding bed 16 of the trampoline. The resilient member may, for example, be directly supported by legs 36 that support a frame on which the rebounding bed 12 is stretched, or may be mounted on the bed 12 itself. Or one or more mats, or other types of resilient members, could be supported by poles 44 that extend upwardly from a frame.

The illustrated system includes a plurality of such poles 44 that extend vertically. Each pole 44 extends upwardly from one of the legs 36. In the illustrated embodiment, each pole 44 is made in two sections and connected at a swage joint, with the two pieces secured together by a set screw. A single-piece pole can also be used, or a pole comprised of more than two pieces secured end-to-end with swage fittings and set screws can be used. A generally cylindrical wall 100 of a flexible material is suspended between the poles 44 to define a chamber above the rebounding surface 16. Enclosures of this type will be understood by reference to U.S. Pat. No. 6,261,207.

Figure 5:
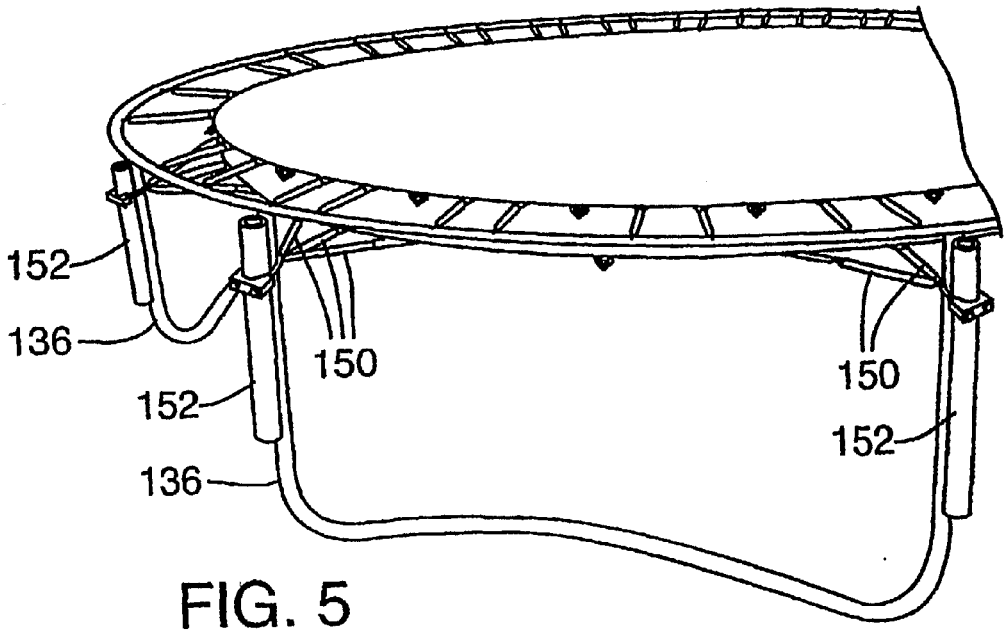
FIG. 5 is a perspective view of a second plural-bed trampoline system.
Figure 6:
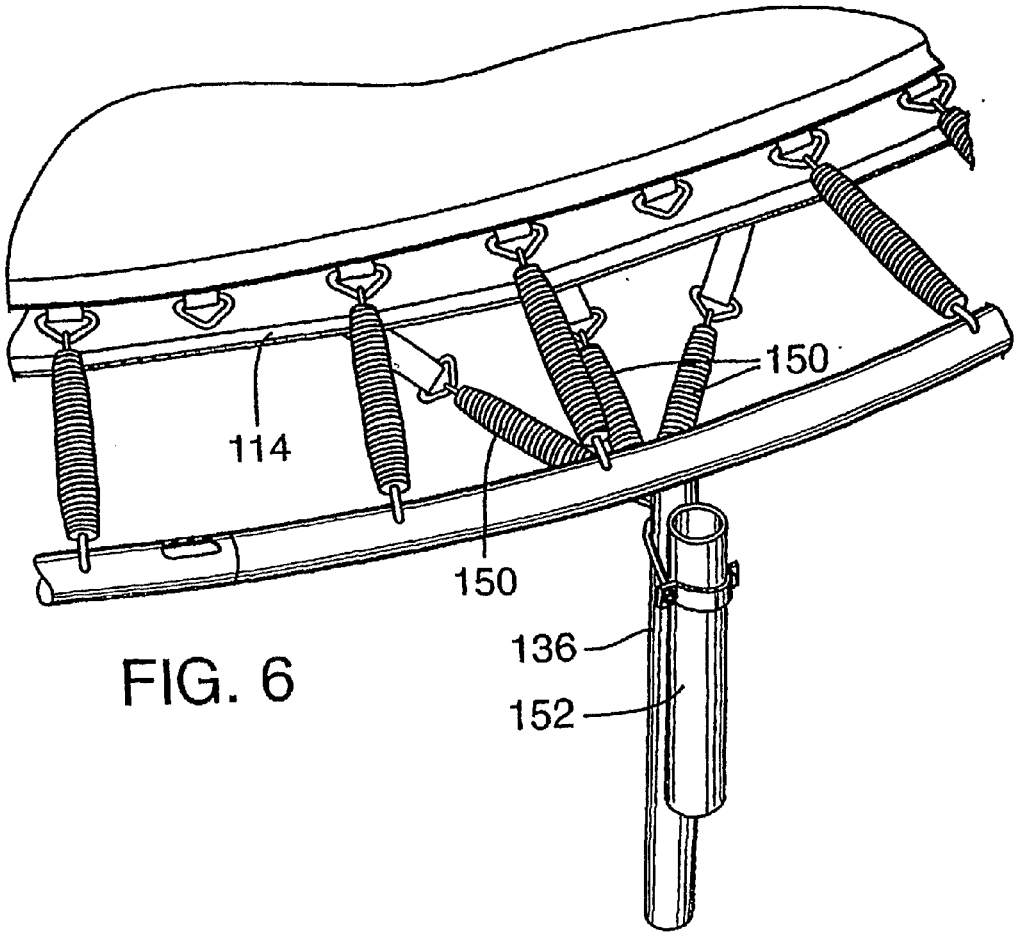
FIG. 6 is an enlarged partial perspective view of the system of FIG. 5.

In the system shown in FIGS. 5–6, an illustrated lower bed 114 is not directly connected to a circular frame, but instead is held in place by springs 150 that extend between a mat 114 and support legs 136 of the trampoline system. An elongated leg bracket 152 serves as the attachment location for each of several springs that extend to spaced-apart locations on the mat. But in other embodiments, the springs could be directly attached to the legs.

There are still other ways to support a resilient member. For example, a standard top rail could have several extension brackets that attach to the top rail and extend below it with one or more springs of a lower bed are attached near the bottom of each bracket.

Still another system uses an inelastic but flexible cord instead of a bottom rail, with the springs of a lower bed attached to the cord.

The resilient member need not be of the same construction as the rebounding bed. In particular, the resilient member need not be a bed of conventional trampoline fabric, but could for example be constructed from multiple crisscrossing elastic cords in various patterns to form a lower bed.

It will be appreciated that a number of elements can be varied to effect the performance of the trampoline system. The size of the upper and lower rails can be varied, as can the size, shape, and porosity of the bed materials. The responsiveness of this system can be adjusted by selecting the upper and lower bed materials to increase or decrease the airflow through the surfaces of the beds.

It is possible to employ a cushion having a construction other than that of an air bladder. (Although a bladder is advantageous because when a jumper impacts the rebounding mat and thereby presses down on one portion of a bladder, air is transferred to and expands other portions of the bladder, where a second jumper is more likely to land if there are two jumpers using the trampoline.) For example, the cushion could be a shock-absorbing spring system or resilient foam placed between beds to help maintain the spacing between the beds during an impact and to modify the shock-absorbing properties of the system.

Figure 7:
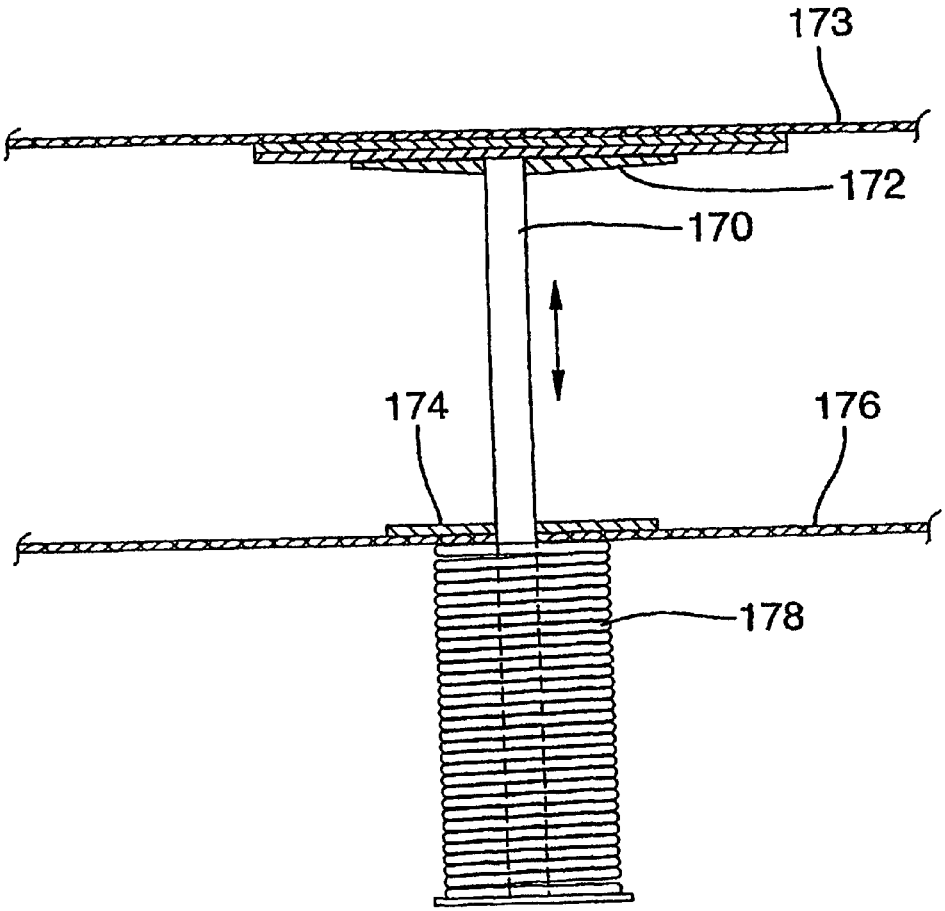
FIG. 7 is a schematic view of a spring serving as a cushion between upper and lower trampoline mats.

One suitable spring system is show in FIG. 7. Each of multiple spaced-apart springs comprises a piston 170 that extends downwardly from a distribution plate 172 at an upper mat 173 and through a retainer 174 and an opening in the lower mat 176. A coil spring 178 below the lower mat elongates when sufficient force is applied to the top of the upper mat to depress the piston.

A bladder with a sealable air intake valve is advantageous because one can adjust the performance of the system by inflating the bladder to a desired firmness.

One particular type of bladder would be not be tightly sealed, but would have one-way (flapper) valves that would allow air into the bladder, but would impede the escape of air. Such a bladder, if connected to both upper and lower mats, would self-inflate when the mats moved apart from each other. When a jumper impacts the upper mat, the bladder would be firm and would not let air escape or would let air escape only slowly so as to provide a cushioning effect. The rate of air escape from the bladder could be adjusted to tune the system.

The characteristics of the system could also be altered adjusting the rate of airflow from between two spaced beds. For example, the porosity of mat material can be selected to allow slow or rapid passage of air thorough one or more mats as needed to achieve a particular result. Or a material can be attached between the beds to slow the movement of air between the upper and lower beds, increasing the cushioning effect of the air and decreasing the system's responsiveness. Such a material might be skirt that extends between upper and lower rails to inhibit the exit of air from the region between two mats. The skirt could be made of any material of a desired porosity, or gaps could be provided between the skirt and the frame rails to serve as air release ports.

A bottom-cushioned trampoline bed has several advantages over the prior systems. If the bed "bottoms out" or hits the ground during a rebound cycle the cushion will absorb the shock and protect the jumper.

What is claim is:

1. A trampoline system comprising:

a frame a rebounding bed supported by the frame; and a resilient member located below the bed at such a position that the bed depresses the resilient member when the bed is sufficiently depressed by a person jumping on the bed.

2. The trampoline of claim 1 wherein the resilient member is a bed of planar material that is positioned at a distance below and extends generally parallel to the rebounding bed and that is supported by the frame.

3. The trampoline of claim 1 wherein:

the frame is supported by a plurality of legs; and the resilient member is connected to and supported by the legs.

4. The trampoline of claim 1 wherein the resilient member is a sheet of fabric that is stretched on the frame.

5. The trampoline of claim 1 wherein the distance between the rebounding bed and the resilient member is at least six inches.

6. The trampoline of claim 1 wherein resilient member comprises a cushion member located below the bed.

7. The trampoline of claim 6 wherein the cushion member comprises an inflated bladder.

8. The trampoline of claim 7 wherein the bladder is filled with air.

9. The trampoline of claim 7 wherein the bladder is generally ring-shaped.

10. The trampoline of claim 7 wherein the bladder has a plurality of attachment loops adapted for connection to the tethers.

11. The trampoline of claim 10 wherein the loops extend from the bladder generally toward the frame.

12. The trampoline of claim 7 wherein the bladder is tethered to the frame by a plurality of elongated tethers extending between the bladder and the frame.

13. The trampoline of claim 7 wherein the bladder is generally horizontally centered below the bed.

14. The trampoline of claim 6 wherein:

the resilient member further comprises a bed of planar material that is positioned at a distance below and that extends generally parallel to the rebounding bed; and the cushion member is located between the rebounding bed and the lower bed of planar material.

15. The trampoline system of claim 1 further comprising:

a plurality of upwardly extending poles, each pole being secured to the frame; and a mat secured to the poles.

16. The trampoline of claim 1 wherein:

the frame is supported by a plurality of legs; and the resilient member comprises a sheet of fabric that is stretched on the frame and that is positioned at a distance below and extends generally parallel to the bed and a cushion member that is located between the bed and the sheet of fabric.

* * * * *